United States Patent [19]

Rand

[11] Patent Number: 4,521,901

[45] Date of Patent: Jun. 4, 1985

[54] SCANNING ELECTRON BEAM COMPUTED TOMOGRAPHY SCANNER WITH ION AIDED FOCUSING

[75] Inventor: Roy E. Rand, Palo Alto, Calif.

[73] Assignee: Imatron Associates, South San Francisco, Calif.

[21] Appl. No.: 471,199

[22] Filed: Mar. 1, 1983

[51] Int. Cl.[3] ..... H01J 35/30; H01J 35/14

[52] U.S. Cl. ..... 378/138; 378/12; 378/123

[58] Field of Search ..... 378/12, 138, 123

[56] References Cited

U.S. PATENT DOCUMENTS 3,344,298 9/1967 Martin ..... 378/138

3,510,713 5/1970 Bennett ..... 378/138

*Primary Examiner*—Alfred E. Smith

*Assistant Examiner*—T. N. Grigsby

*Attorney, Agent, or Firm*—Flehr, Hohbach, Test, Albritton & Herbert

[57] ABSTRACT

An electron beam production and control assembly especially suitable for use in producing X-rays in a computed tomography X-ray scanning system is disclosed herein. In this system, an electron beam is ultimately directed onto an X-ray producing target in a converging manner using electromagnetic components to accomplish this. The system also includes an arrangement for neutralizing the converging beam in a controlled manner sufficient to cause it to converge to a greater extent than it otherwise would in the absence of controlled neutralization, whereby to provide ion aided focusing.

22 Claims, 9 Drawing Figures

SCANNING ELECTRON BEAM COMPUTED TOMOGRAPHY SCANNER WITH ION AIDED FOCUSING

Figure 1:
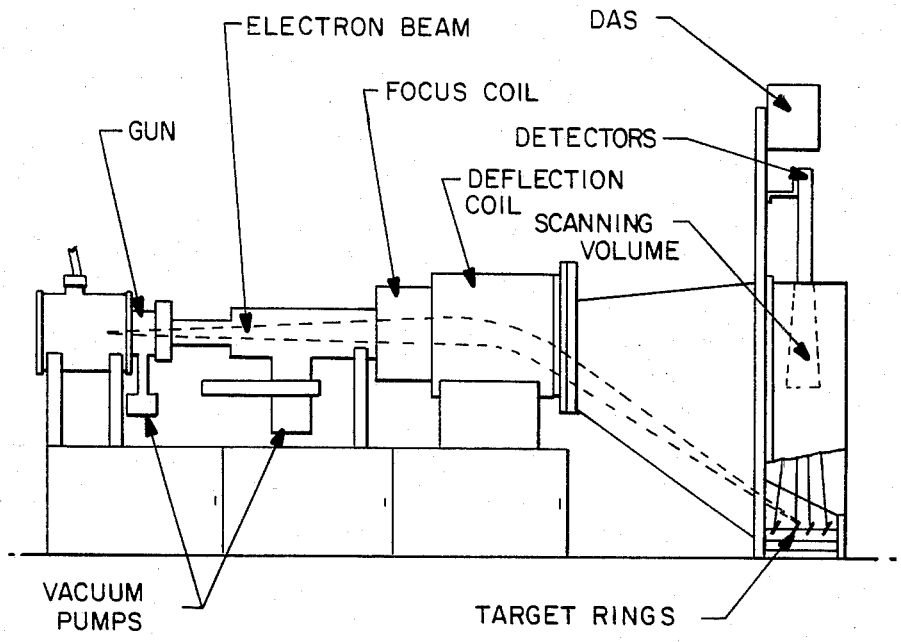

The present invention is directed to various modes of controlling the scanning electron beam, which produces X-rays in a computed tomography X-ray transmission scanner and more particularly to a control technique which takes advantage of the ionization by the beam of the ambient gas in the scan tube which, in turn, results in the production of positive ions for neutralizing the space charge of the electron beam and causes it to become self focusing. The invention also overcomes the problem of target degassing in this type of scanner.

There are a number of different types of X-ray transmission scanning systems described in the literature, including that described by Boyd et al U.S. Pat. No. 4,352,021 (hereinafter referred to as the Boyd Patent). In this latter patent which is incorporated herein by reference and applicant's pending U.S. application Ser. No. 434,252, filed Oct. 14, 1982, and entitled ELECTRON BEAM CONTROL ASSEMBLY AND METHOD FOR A SCANNING ELECTRON BEAM COMPUTED TOMOGRAPHY SCANNER (hereinafter referred to as the Rand application), also incorporated herein by reference, there is a system corresponding to the system illustrated in FIG. 1. In this system an electron beam is produced inside a highly evacuated chamber by an electron gun. The beam expands from its point of origin, because of the mutual electrostatic repulsion of the electrons in the beam. Where the beam is sufficiently large, it passes through a magnetic lens (solenoid) and a dipole deflecting magnet which scans the beam along a tungsten target located at the far end of a conical vacuum chamber. The solenoid serves to focus the beam to a small spot on the target. Throughout the path of the beam, the self forces of the beam are dominated by its space charge, i.e. the electrons mutually repel each other. This repulsion limits the minimum beam spot size, which in the case of unit beam optical magnification, and cylindrical symmetry with respect to the beam axis can be no smaller than the size of the initial beam waist at the electron gun.

The above description represents only one mode of operation of such a scanner. Variations are possible which depend on the beam optical properties of the magnetic devices and on the presence of positive ions in the beam due to ionization by the beam of the ambient gas in the vacuum chamber. It is also possible to modify the design of the electron gun to cause the beam to expand independently of self forces.

Whatever mode of operation is chosen, the electron beam optics of the scanner must be arranged in such a way that the beam expands from the electron gun to the solenoid lens and converges from the lens to a small spot on the target. Were it not for the fact that the deflecting dipole magnet just downstream from the solenoid also acts as a converging lens, other configurations might be possible. As it is, the effective focal length of the dipole defines a minimum rate of divergence for the beam at the solenoid/dipole position, if the beam is to be focused at the target. Also the final beam spot size varies approximately inversely as the beam size at the solenoid/dipole. Therefore the beam should be large at this point, again implying the necessity of a diverging beam from the gun.

In a scan tube with a very high degree of vacuum, the electron beam from the gun is self-diverging because of the repulsion due to its own charge. If the same conditions apply in the second section of the scan tube, the size of the beam spot at the target is then determined by the space charge of the beam. In order to realize such a system, the speed of the vacuum pumps must be adequate to cope with the normal degassing of the chamber inner walls and with the considerable degassing of the target when struck by the high power electron beam. This mode of operation requires a vacuum pressure of less than $5\times10^{-8}$ Torr and is the mode of operation originally envisioned by the system in the Boyd patent.

In practice, in an all metal scan tube it is difficult to maintain a residual gas pressure low enough to realize the above ideal. Normally there is sufficient residual gas in the tube to form a significant number of positive ions by interaction of the beam electrons with the gas molecules. These ions are captured by the potential well(s) formed by the beam and thus they tend to partially neutralize it as discussed in the Rand patent application. The neutralization and therefore the self forces of the beam depend on the fluctuating residual gas pressure—an intolerable situation. To overcome this problem, ion collecting electrodes described in the Rand patent application just mentioned have been provided to remove ions from the beam.

It is the primary object of the present invention to provide another different mode of operation for the above-mentioned scanner, specifically ion aided focusing (I.A.F.) which has the advantage of producing a considerably smaller beam spot at the target than space charge limited operation. In this mode, gas is deliberately introduced into the vacuum chamber.

Above a certain threshold ambient gas pressure, it is possible for the ionic neutralization of the space charge of the beam to attain such a value that the beam becomes self focusing, i.e. the mutual magnetic attraction of the electrons exceeds the electrostatic repulsion. This situation is not tolerable in the first section of the tube where the beam must expand but is desirable in the second section since the self-focused beam will produce a beam spot which is smaller than that of a space charge limited beam, even in the presence of multiple scattering in the ambient gas.

This type of scanner which will be described in more detail hereinafter, therefore, has some means of causing the beam to expand in the first section of the tube, from the gun to the lens, and employs a self-focused beam in the second section, from the lens to the target. Since it is neither possible nor desirable for the beam to be entirely self-focusing, an adjustable magnetic solenoid lens must still form part of the system in order to provide control of the focusing. The focusing is therefore referred to as "ion aided". Some means of controlling the gas pressure is also required.

It goes without saying that a necessary condition for the operation of the scanner is that the focusing of the electron beam be insensitive to ambient gas pressure fluctuations. It is also desirable that the radius of the beam spot at the target be as small as possible. This is achieved by selecting a gas pressure where the rate of decrease with pressure of electron beam spot size, due to ion aided focusing, is balanced by the rate of increase of spot size, due to multiple scattering in the ambient gas.

This occurs in the neighborhood of the threshold pressure for self focusing, a pressure usually in the range $10^{-6}$–$10^{-5}$ Torr. A second aspect of stability is that the neutralization of the beam in the first half of the tube be very small so that the beam expands to the required dimension at the lens. At this gas pressure, this condition can only be satisfied by removing ions from the beam by means of ion collecting electrodes, as described in the previously recited Rand application.

In addition to the foregoing, I.A.F. overcomes the problem of target degassing which seems to be inherent in a scanner with high vacuum (and space charge limited focusing). This is because I.A.F. makes use of the ambient gas and does not attempt to maintain a high vacuum. In those systems not using I.A.F. (i.e., requiring a high vacuum), whenever the beam is scanned along the target, the latter is instantaneously heated and emits (unknown) gases sufficient to raise the residual or ambient gas pressure to a level where undesirable effects occur. In the I.A.F. approach, the emitted gases do not cause a significant pressure change.

Another essential component of the system is magnetic quadrupole lenses installed inside or close to the dipole magnet coils. These are used to equalize the focal lengths of the dipole in the bend and transverse planes, regardless of azimuthal angle of bend, so as to produce a circular beam spot at the target and thus maximize the self focusing forces of the beam.

Figure 2:
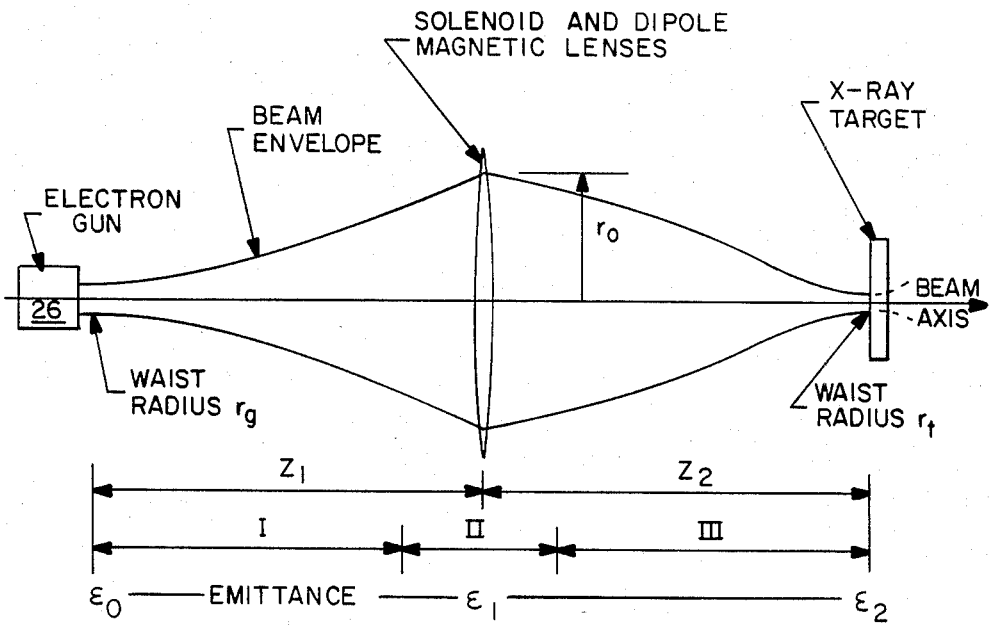
Figure 3:
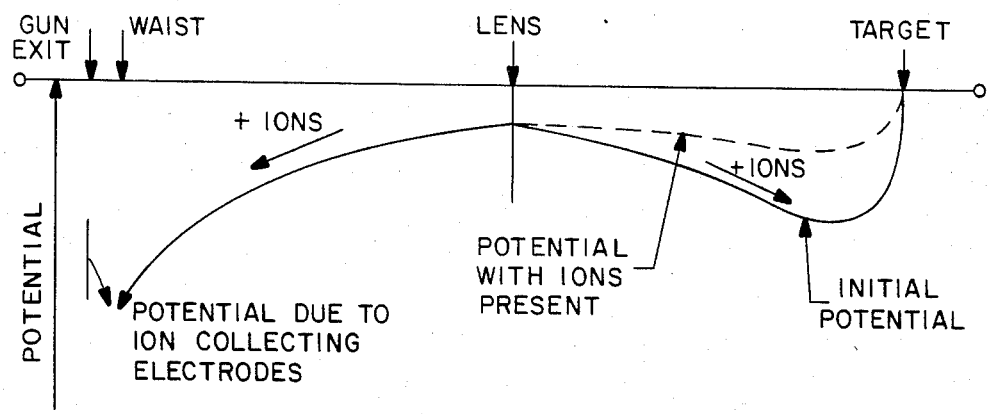
Figure 4:
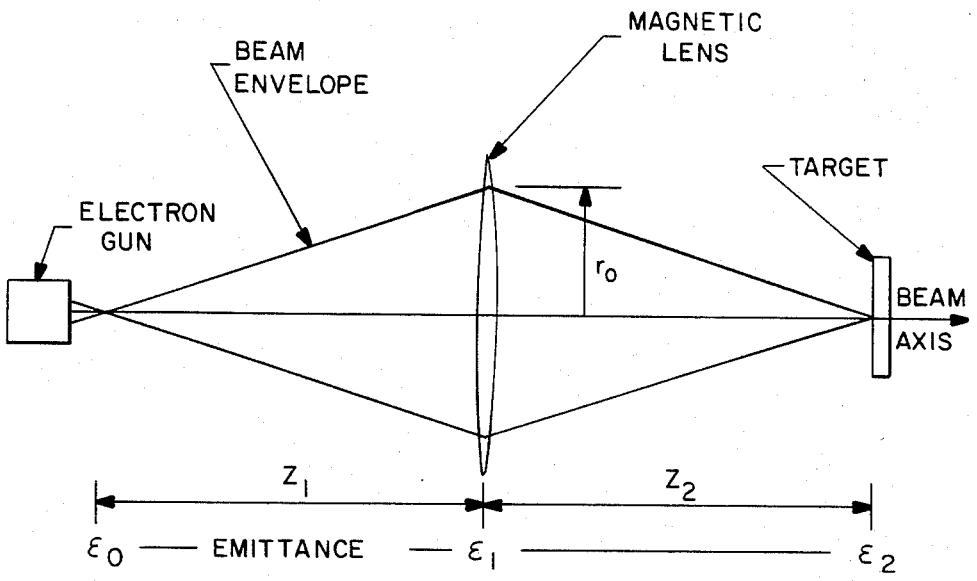
Figure 5:
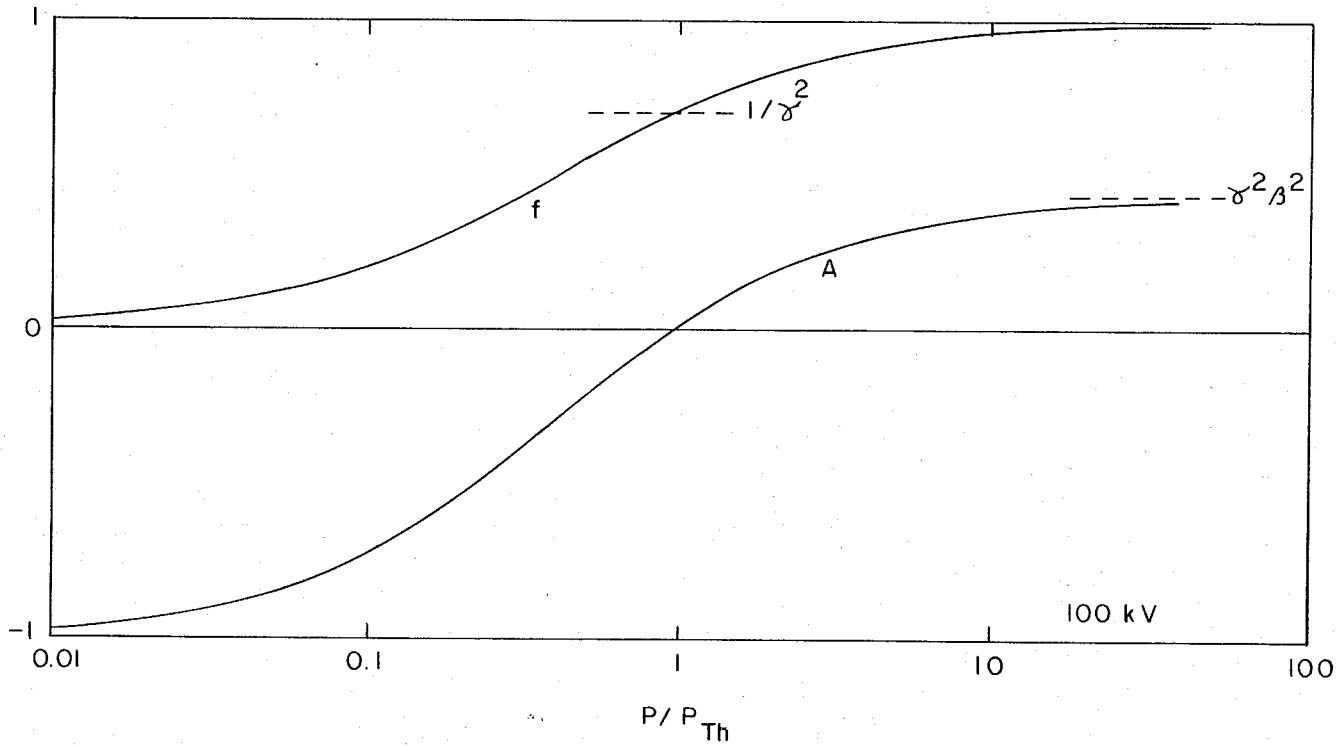
Figure 6:
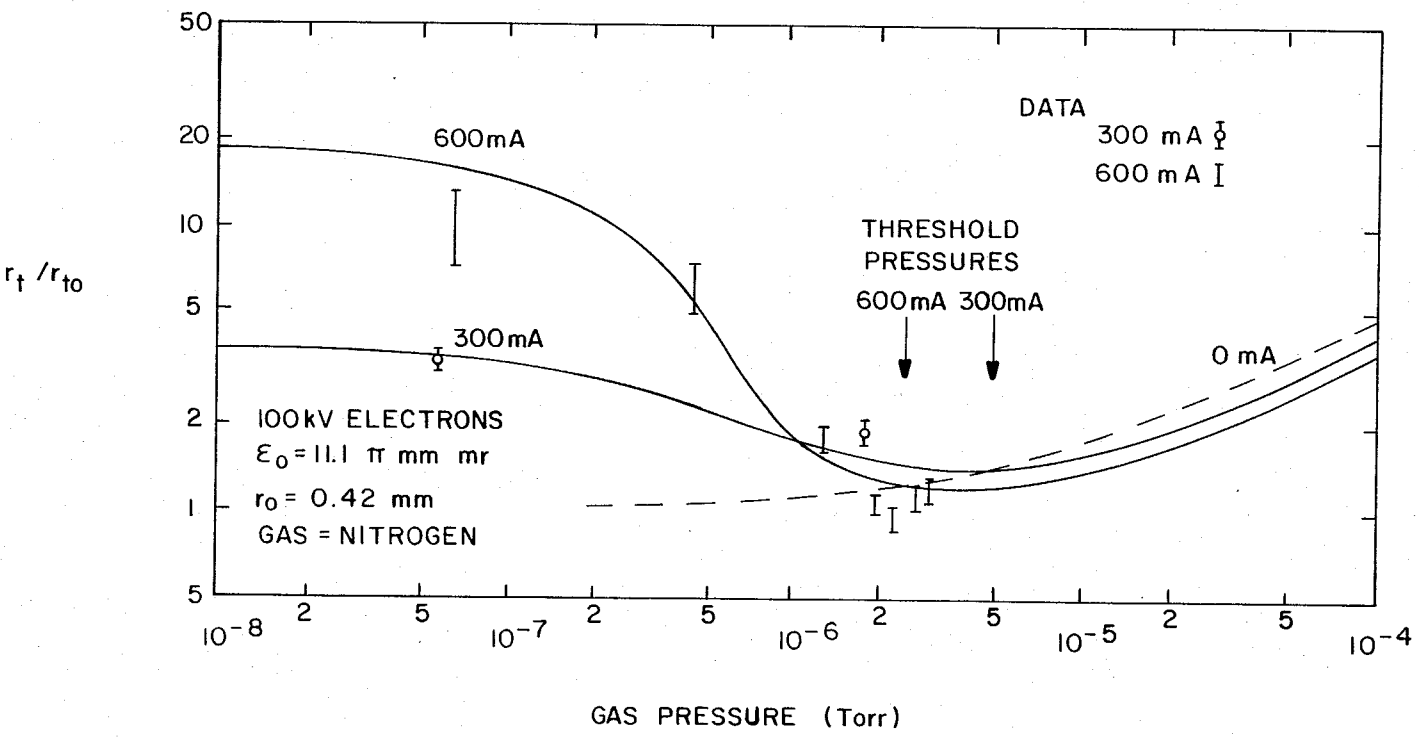
Figure 7:
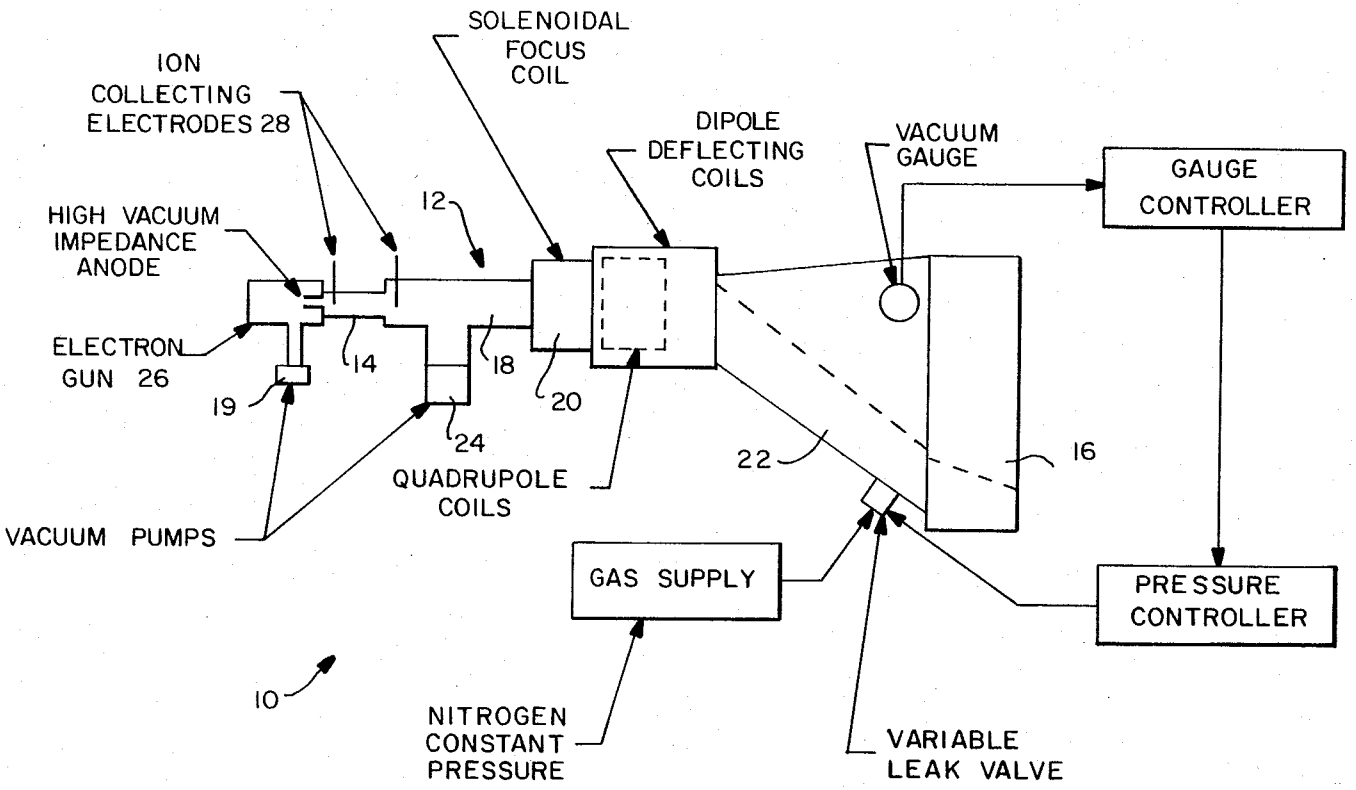
Figure 8:
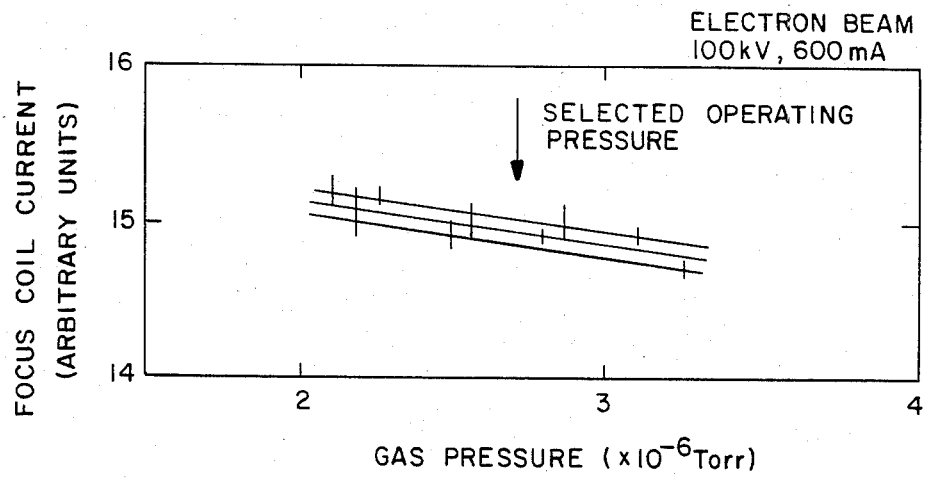
Figure 9:
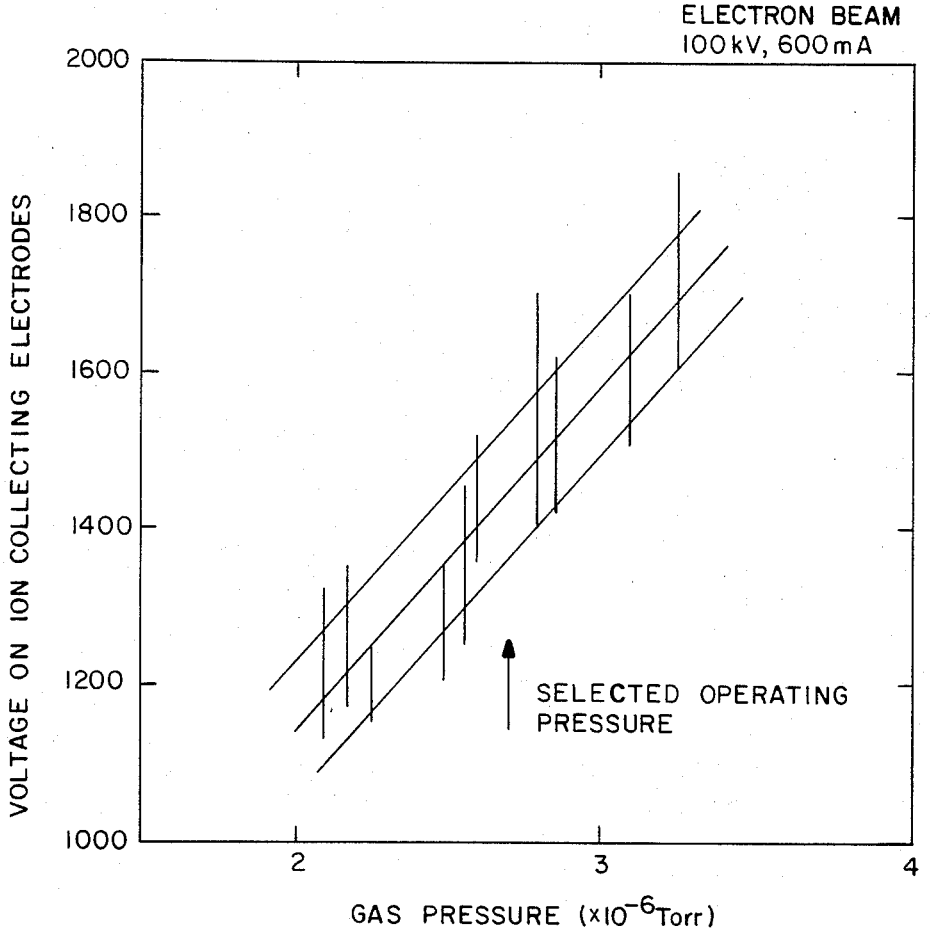

Attention is now directed to the drawings wherein:

FIG. 1 is a side elevational view of a scanning electron beam computed tomography X-ray scanner of the type described in Boyd et al U.S. Pat. No. 4,352,021;

FIG. 2 schematically illustrates an electron beam envelope (where beam deflection is omitted) in a scanning electron beam computed tomography X-ray scanner designed in accordance with the present invention to include ion aided focusing;

FIG. 3 illustrates schematically the distribution of electrostatic potential on the axis of the beam illustrated in FIG. 2;

FIG. 4 defines an approximate model for calculating emittance growth of the electron beam in FIG. 2 due to multiple scattering in the ambient gas;

FIG. 5 illustrates the variation of neutralization fraction, f, and attraction factor, A, with ambient gas pressure, for a 100 kV electron beam, the pressures being normalized to the threshold pressure for ion aided focusing at which $A=0$ by definition;

FIG. 6 graphically illustrates the variation of beam spot radius with ambient gas (nitrogen) pressure for 100 kV electrons, experimental data and theoretical curves being shown for beam currents of 0, 300 mA and 600 mA with radii being normalized to the emittance limited radius measured at low pressure with low beam current;

FIG. 7 diagrammatically illustrates the features of the scanning electron beam computed tomography X-ray scanner designed in accordance with the present invention to include ion aided focusing;

FIG. 8 graphically illustrates the variation of solenoidal focus coil current with ambient gas pressure, the experimental data and lines drawn through the data showing the permissible range of settings; and FIG. 9 graphically illustrates the variation of voltage on ion collecting electrodes with ambient gas pressure, again the experimental data and lines drawn through the data showing the permissible range of settings.

Turning now to the drawings, attention is initially directed immediately to FIG. 7 which, as stated above, diagrammatically illustrates a scanning electron beam computed tomography X-ray scanner. Actually, FIG. 7 only shows an electron beam production and control assembly forming part of the scanner which also includes a detector array and a data acquisition and computer processing arrangement not shown in FIG. 7. These latter components are illustrated in the Boyd patent and the Rand application. As illustrated in FIG. 7, the electron beam production and control assembly which is generally indicated at 10 includes an overall housing 12 which defines an elongated vacuum-sealed chamber extending from its rearwardmost end 14 to its forwardmost end 16. This chamber may be divided into three sections, a rearwardmost chamber section 18, an intermediate section 20 and a forwardmost section 22. Gas is pumped out of the overall chamber by means of a vacuum pump 24 or other such suitable means.

An electron gun 26 is located adjacent the rearwardmost end of chamber section 18 for producing a continuously expanding electron beam (see FIG. 1) and for directing the latter through rearward chamber section 18 towards intermediate section 20 in a continuously outwardly expanding manner. The particular electron gun shown has a high vacuum impedance anode which permits differential pumping so that the residual gas pressure in the gun can be maintained at a much lower value than the gas pressure in the chamber. To this end, the electron gun includes its own vacuum pump 19.

Intermediate chamber section 20 includes suitable means for bending the incoming beam into forwardmost chamber section 22 for impingement on an X-ray producing target, and for scanning the beam along the target, the X-rays being produced in a fan-like fashion (again see FIG. 1 and also the Boyd patent and the Rand application). As described in detail in the Boyd et al patent, when the electron beam impinges the X-ray target it produces X-rays which are directed toward a patient. In this regard, while the target could be of any suitable material, in a preferred embodiment it is selected for high X-ray production, for a high melting point and for a reasonable price. As illustrated in FIG. 7, the means in chamber section 20 includes a solenoidal focus coil, dipole deflecting coils and quadrupole coils. The quadrupole coils cooperate with the dipole deflecting coils by equalizing the focal lengths of the combination in the bend plane of the beam and in the transverse plane therethrough, regardless of the azimuthal angle of the bend, whereby to allow for a circular beam cross-section.

Electron beam production and control assembly 10 as described thus far may be identical to the one described in the Boyd patent or the Rand patent application (except for the use of the quadrupole coils). Accordingly, chamber section 18 includes a series of ion collecting electrodes 28 which are described in detail in the Rand application. The chamber also includes a solenoidal focus coil and dipole deflecting coils which serve to bend the expanding beam into chamber section 22 and at the same time focus it onto the X-ray producing target, in a continuously converging manner from intermediate chamber section 20 to the target. However, the electron beam production and control assembly 10 illustrated in FIG. 7 and described in detail herein differs from the assemblies illustrated and described in the Boyd patent and Rand application to the extent that the present embodiment includes what is referred to as ion aided focusing. More specifically, assembly 10 includes means for neutralizing the space charge of the converging segment of the beam, that is, that portion in chamber 22, in a controlled manner sufficient to cause it to converge to a greater extent that it otherwise would in the absence of controlled neutralization. In this way, the beam is made to impinge the X-ray target in a smaller area than would be the case without controlled neutralization. Stated another way, the beam spot on the target is made smaller as a result of the controlled neutralization.

The precise theory behind controlled neutralization leading to ion aided focusing will be discussed in detail hereinafter. For the moment it suffices to say that the presence of residual or ambient gas in the vacuum chamber along with the electron beam results in the production of ions. These ions function to neutralize the beam, as discussed more fully in the Rand patent application. This is entirely undesirable in the rearward section 18 of the chamber where the beam is expanding since neutralization would cause the beam to collapse. It is also undesirable elsewhere in the chamber if it takes place in a random, uncontrolled manner. However, in accordance with the present invention, controlled neutralization is taken advantage of to aid in the controlled collapse (convergence) of the beam in the forward section. This occurs for the following reasons. The electron beam itself is made up of electrons having negative charges which produce electrostatic repulsive forces between the electrons. At the same time, the beam produces its own magnetic field resulting in opposing attractive forces which are normally less in magnitude than the repulsive forces whereby the beam has a natural tendency to expand. In accordance with the present invention, the space charge of this beam is neutralized (by means of positive ions from ionized gas present in the chamber) in a manner which reduces the repulsive forces to a magnitude approximately equal to the magnitude of the attractive forces, whereby the area of the target impinged by the beam is limited in size only by the emittance of the beam. In a preferred embodiment, the beam is neutralized in a manner which reduces its repulsive forces to a magnitude below the magnitude of the attractive forces whereby the beam becomes self-focusing.

Returning to FIG. 7, the neutralizing means shown there includes a constant pressure gas supply, suitably nitrogen gas, which provides gas for injection into chamber section 22 in a controlled manner. The neutralizing means also includes a variable leak valve, a pressure sensor (vacuum gauge) disposed within chamber section 22, a gauge controller, a pressure controller and the vacuum pump 24. The gauge, gauge controller and pressure controller cooperate with the variable leak valve and with the gas supply and with the vacuum pump so as to either leak gas into or pump gas out of the chamber 22 in order to maintain the chamber at a preset gas pressure which will be discussed in detail hereinafter. For the moment it suffices to say that this gas pressure is selected to provide the desired ionization and hence controlled neutralization of the already converging beam.

Having described immediately above the IAF scanner 10 generally, attention is now directed to its theory of operation, in detail, starting with the way in which the beam itself behaves theoretically. For purposes of better understanding, the following discussion will include various headings and subheadings.

1.0 THEORY OF BEAM BEHAVIOR IN THE IAF SCANNER

1.1 Beam Envelope Equation

For a cylindrically symmetric electron beam with uniform current density, under the influence of self-forces (electrostatic and magnetic) and multiple scattering in the ambient gas, the equation of motion of the beam envelope radius, r, has been given by Lee and Cooper (E. P. Lee and R. K. Cooper, Particle Accelerators 7, 83, 1976):

$$\frac{d^2r}{dz^2} = -\frac{SA}{2r} + \frac{\epsilon_o^2}{r^3} + \frac{1}{r^3}\int_{z_o}^{z} r^2 g\, d\zeta \qquad (1)$$

where z is in the direction of motion $\epsilon_o$ is the initial beam emittance at $z=z_o$ where "emittance" is the area of the beam in phase space. More specifically, "emittance" as used in equation (1) is measured in radius-units multiplied by radians and is defined as the area of the beam in displacement-deflection space divided by $\pi$.

S describes the self-forces

A is the attraction factor and g describes the multiple scattering by the gas.

The parameter S is given by:

$$S=\sqrt{2m}\eta_o KI/I_{SAT}$$

where m is the electron rest mass (in volts)

$\eta_o=30\Omega$ is the resistance of free space

K is the perveance of the electron gun

I is the beam current and $I_{SAT}$ is the saturated beam current given by:

$$I_{SAT}=K[T(1+T/2m)]^{3/2}$$

where T is the kinetic energy of a beam electron (in volts).

The attraction factor, A is given by:

$$A=\gamma^2 f-1 \qquad (2)$$

where $\gamma$ is the Lorentz factor of a beam electron, and f is the neutralization fraction due to positive ions in the beam, i.e., f= |ion charge density/electron charge density|

In general A and f are functions of z.

The multiple scattering parameter, g, may be derived from a formula due to Lauer (E. J. Lauer, Lawrence Livermore Lab. Rept. UCID-16716, March 1975):

$$g = \frac{10.46\, Z(Z+1)r_e^2 N_A}{\gamma^2\beta^4} \ln\left(\frac{\gamma\beta}{\alpha Z^{\frac{1}{3}}}\right) \qquad (3)$$

where

Z is the effective atomic number of the ambient gas, $r_e$ is the classical electron radius, $\beta$ is the velocity of a beam electron divided by the velocity of light, $[\gamma^2(1-\beta^2)=1]$ $\alpha=1/137$ is the fine structure constant and $N_A = N_o\rho/A$ is the number of gas atoms per unit volume where $N_o$ is Avogadro's number, $\rho$ is the ambient gas density and A is its effective atomic mass.

The numerical factor (10.46) in equation (3) derives from three factors: "$8\pi$", the theoretical factor from the standard multiple scattering theory; "$\sqrt{\ln 2}$" to allow for the fact that the standard theory refers to "1/e" half widths of distributions whereas in practice half widths at half maximum are measured; and "0.5", since the multiple scattering distributions are projected onto a plane.

Solutions to equation (1) will be discussed in the context of the I.A.F. scanner 10. FIG. 2 is a schematic diagram of the electron beam envelope in the approximation that it is cylindrically symmetric. Any indication of deflection has been omitted for clarity. The converging beam in the electron gun 26 forms a waist close to the exit of the gun. The beam then expands until it reaches the magnetic lens, formed by the solenoid and dipole coils of the scanner referred to previously, after which it converges to a waist at the X-ray target 22. Throughout the beam path, from gun to target, the emittance of the beam increases significantly due to multiple scattering in the ambient gas.

The beam path is divided into three regions as shown in FIG. 2. In region I, positive ions formed in the gas by the beam are removed from the beam by means of ion collecting electrodes as described in the Rand copending application. This ensures that inspite of the significant gas pressure, the neutralization of the beam is small and electrostatic repulsive forces dominate. The converging beam from the gun therefore forms a waist, near the gun exit, whose radius is determined by these forces. The beam then continues to expand because of the self-repulsion. In region II, near the lens, the beam is partially neutralized, but is of such a radius that self-forces are very small and its motion is essentially ballistic. In this region, the magnetic lens reconverges the diverging beam. In region III, positive ions formed in the gas by the beam accumulate in the potential well due to the beam until equilibrium is reached. The beam is then under the influence of almost-balanced electrostatic and magnetic self-forces which may actually cause the beam convergence to increase. Finally, the beam forms a waist whose size depends strongly on the beam emittance. The X-ray target is located at this waist.

FIG. 3 shows schematically the form of the electrostatic potential wells formed by the beam. In the expanding section of the beam, positive ions formed from the gas, flow against the beam direction to the minimum of the potential distribution at the waist of the beam. At that location (and possibly others) ions are attracted out of the beam by the ion collecting electrodes. In the converging part of the beam, the initial potential well is bounded by a zero (ground) potential plane at the target. Ions therefore accumulate in this well until the neutralization reaches an equilibrium value. As new ions are formed, ions then leave the beam at the same rate, having acquired potential energy at their creation.

1.2 Calculation of the Multiple Scattering Term

Having discussed the beam envelope with reference specifically to its equation of motion, attention is now directed to a way of calculating the multiple scattering term in equation (1) above.

FIG. 4 shows schematically an approximate beam envelope model which may be used to calculate the multiple scattering term in equation (1). This model employs purely conical beam envelopes. The model is only expected to be inaccurate near the waists of the beam where there is very little contribution to the multiple scattering integral.

In the expanding section of the beam, we have $$\int_o^z r^2 g\,d\zeta \simeq \frac{gr_o^2}{z_1^2}\int_o^z \zeta^2 d\zeta = \frac{gr_o^2}{3z_1^2}z^3 = \frac{gz_1r^3}{3r_o} \tag{4}$$

Hence by inspection of equation (1), the beam emittance at the lens, $\epsilon_1$ is given by:

$$\epsilon_1^2 \approx \epsilon_o^2 + \frac{gr_o^2 z_1}{3} \tag{5}$$

In the converging section of the beam, we have $$\begin{aligned}\int_{z_1}^z r^2 g\,d\zeta &\simeq \frac{gr_o^2}{z_2^2}\int_{z_1}^z [(z_1+z_2)-\zeta]^2 d\zeta \\ &= \frac{gr_o^2}{3z_2^2}[z_2^3-(z_1+z_2-z)^3] \\ &= \frac{gz_2}{3r_o}(r_o^3-r^3)\end{aligned} \tag{6}$$

Hence the beam emittance at the target, $\epsilon_2$ is given by:

$$\epsilon_2^2 = \epsilon_1^2 + \frac{gr_o^2 z_2}{3} = \epsilon_o^2 + \frac{gr_o^2(z_1+z_2)}{3} \tag{3}$$

1.3 Solutions of the Beam Envelope Equation for the Expanding Beam

In this section the self-forces of the beam are repulsive and we shall write the repulsion factor, $$N = -A = 1 - \gamma^2 f$$

where $f << 1$

The beam envelope equation (1) becomes, using equation (4)

$$\frac{d^2r}{dz^2} = \frac{SN}{2r} + \frac{\epsilon_o^2}{r^3} + \frac{gz_1}{3r_o} \tag{8}$$

Integrating equation (8) once, we obtain:

$$\left(\frac{dr}{dz}\right)^2 = SN\ln r - \frac{\epsilon_o^2}{r^2} + \frac{2gz_1r}{3r_o} + \text{const} \tag{9}$$

from which the general solution may be written $$z = \frac{dr}{(dr/dz)} \tag{10}$$

Three cases of equation (9) are of interest. In each case for $r < r_o/3$, the multiple scattering term may be neglected.

(a) Low currents, $S \simeq 0$

We define the radius of the beam at the gun waist ($dr/dz=0$) to be $r_{go}$. Hence, from equation (9):

$$\left(\frac{dr}{dz}\right)^2 = \epsilon_o^2\left(\frac{1}{r_{go}^2} - \frac{1}{r^2}\right) \tag{11}$$

The solution of equation (10) is then:

$$r^2 = r_{go}^2 + z^2\epsilon_o^2/r_{go}^2,$$

the well known equation for an emittance limited beam.

(b) Intermediate currents

In this case both the self-force term and the emittance term in equation (9) are significant and we use the boundary condition $dr/dz = r_o'$ at $r = r_o$. Hence:

$$\left(\frac{dr}{dz}\right)^2 = r_o'^2 - SN\ln\frac{r_o}{r} - \epsilon_o^2\left(\frac{1}{r^2} - \frac{1}{r_o^2}\right) \tag{12}$$

Equation (12) enables one to find an approximate expression for the radius of the beam at its initial waist, $r = r_g$, by using the derivative in equation (11) for $r_o'$ and putting $r_g = r_{go}$ in the logarithm. Hence:

$$r_g^2 \simeq r_{go}^2 \Big/ \left[1 - \frac{SNr_{go}^2}{\epsilon_o^2}\ln\frac{r_o}{r_{go}}\right] \tag{13}$$

(c) High currents, $\epsilon_o$ negligible

Where self-forces of the beam dominate, equation (9) becomes:

$$\left(\frac{dr}{dz}\right)^2 = SN\ln\frac{r}{r_g},$$

of which the solution (10) is well known:

$$z = \frac{r_g}{\sqrt{SN}}\int_1^{\Delta}\frac{da}{\sqrt{\ln a}} \tag{14}$$

$$= \frac{2r_g}{\sqrt{SN}}\int_o^{\sqrt{\ln\Delta}}\exp(t^2)\,dt$$

where $\Delta = r/r_g$

Most cases of practical interest occur when the quantity $(SNr_{go}^2/\epsilon_o^2)\ \ln\ (r_o/r_{go})$ is neither very small nor very large. Equation (10) must then be solved numerically. The following section assumes that a solution has been found either theoretically or experimentally and that the geometry of the diverging beam (in particular the radius $r_o$) is known.

1.4 Solution of the Beam Envelope Equation for the Converging Beam

In the second section of the scanner where ion aided focusing occurs, using equations (6) and (7) the beam envelope equation (1) becomes:

$$\frac{d^2r}{dz^2} = \frac{-SA}{2r} + \frac{\epsilon_2^2}{r^3} - \frac{gz_2}{3r_o} \tag{15}$$

Hence we may write:

$$\left(\frac{dr}{dz}\right)^2 = SA\ln\frac{r_o}{r} - \frac{\epsilon_2^2}{r^2} + \frac{\epsilon_o^2}{r_{to}^2} - \frac{2gz_2r}{3r_o} + gz_2 \tag{16}$$

where the constants of integration have been chosen so that:

$$\left(\frac{dr}{dz}\right)^2_{r=r_o} = -\frac{\epsilon_1^2}{r_o^2} + \frac{\epsilon_o^2}{r_{to}^2} \simeq \frac{\epsilon_o^2}{r_{to}^2};$$

i.e. $r_{to}$ is the radius of the beam waist at the target in the absence of multiple scattering and self-forces.

An approximate expression for the radius, $r_t$ of the waist at the target may now be found by putting the R.H.S. of equation (16) equal to zero. This produces an expression analogous to equation (13):

$$r_t^2 \simeq \frac{r_{to}^2\left[1 + \frac{r_o g(z_1 + z_2)}{3\epsilon_o^2}\right]}{\left[1 + \frac{SAr_{to}^2}{\epsilon_o^2}\ln\frac{r_o}{r_{to}}\right]} \tag{17}$$

Equation (17) is of limited validity, but demonstrates explicitly how ion aided focusing influences the size of the beam spot at the target. The radius may be greater than or less than the value ($r_{to}$) it would have when emittance limited, depending on the relative magnitudes of the multiple scattering and self-focusing terms. In practice, it is found that these two terms can be made approximately equal so that $r_t \simeq r_{to}$. This value of the radius is normally considerably less than the radius which would be obtained with space charge limited operation ($g=0$, $A=-1$).

Realistic values of the beam spot radius, $r_t$, for arbitrary beam parameters and gas pressure can be found by equating the R.H.S. of equation (16) to zero and ignoring the very small terms, i.e., by solving:

$$SA\ln\frac{r_o}{r_t} - \frac{\epsilon_2^2}{r_t^2} + \frac{\epsilon_o^2}{r_{to}^2} = 0 \tag{18}$$

In order to discover the optimum ambient gas pressure for I.A.F., i.e., the pressure for the minimum value of $r_t/r_{to}$, it is necessary to know how the attraction factor A varies with gas pressure. This knowledge requires some preliminary discussion of the theory of ion production and the retention of ions in the beam by electrostatic forces. This discussion follows.

2.0 THEORY OF ION PRODUCTION AND RETENTION

2.1 Ionization Cross-Section

As stated previously, positive ions are produced by ionization of the ambient gas in the scanner vacuum chamber, by the beam electrons. This gas is mainly nitrogen or other inert gas which is deliberately introduced into the chamber (see below). The ion production rate may be calculated assuming that the gas consists of single atoms, whereas most of the ions formed are probably $N_2^+$ in the case of nitrogen. This point must be taken into account when the kinematics of the process are considered. Numerical examples below are calculated for nitrogen.

The production cross-section of ions by electrons has been given by Heitler (W. Heitler, "The Quantum Theory of Radiation", Oxford Univ. Press, London, 3rd Ed. 1954):

$$\sigma = \frac{4\pi r_e^2 Zm}{E_p\beta^2}\left[\ln\frac{T}{E_I Z\sqrt{2}} + \frac{1}{2}\right] \tag{19}$$

where $E_p=32$ V and $E_I=12$ V and other parameters have been defined previously. Hence the number of ions produced by the beam is $$\frac{I}{e}\,\sigma N_A \text{ per unit length per unit time} \tag{20}$$

where e is the electronic charge.

The number of electrons per unit length of beam is $N_e=I/(e\beta c)$, where c is the velocity of light. Thus, if no ions escape, the beam will become neutralized in a characteristic time given by:

$$t_n=1/(\beta c p N_A) \tag{21}$$

It is important to point out that the magnitude of $t_n$ is such that ionization takes place rapidly when the electron beam in the scanner first reaches the target. For example at $T=100$ kV, $\rho=2.68\times10^{-18}$ cm$^2$ and $\beta=0.548$. At a typical working pressure of $2.5\times10^{-6}$ Torr, $N_A=1.83\times10^{11}$ cm$^{-3}$. Hence $t_n=0.12$ msec. With the same pressure at $T=16$ kV ($\beta=0.245$), the values are $\rho=10.1\times10^{-18}$ and $t_n=0.07$ msec. The scanning speed of the beam spot on the target is about 6 cm/msec. One would expect therefore that the neutralization of the beam would be essentially stable after a few centimeters of scan.

2.2 Kinematics of Ion Production

Assuming that the electrons scatter isotropically in the ionization process, the average kinetic energy of an ion is given by $$T_I=(\gamma\beta m)^2/M \tag{22}$$

where M is the mass of the ion.

A typical initial velocity of the ions at creation is given by $$v_I=\gamma\beta mc/M \tag{23}$$

2.3 Formation of Potential Wells by the Beam

The electrostatic potential due to its own charge, on the axis of a cylindrical electron beam, radius $r_1$, located centrally in a grounded cylindrical tube, radius R is given by:

$$U=-U_o(1+2\ln(R/r_1)) \tag{24}$$

where $$U_o=\frac{\eta_o I}{\beta}=\frac{1}{4}Sm\beta^2\gamma^3 \tag{25}$$

The potential at an arbitary radius, r, inside the beam is given by:

$$u=U+U_o r^2/r_1^2 \tag{26}$$

In the presence of a grounded target, equation (24) is modified by the image charges of the beam in the target. The new axial potential can then be calculated in the approximation that the target is a disc at zero potential and the beam is treated as a cylinder, radius r at each point. The axial potential is then:

$$U=-U_o\left[\frac{2d^2}{r_1^2}\left(\sqrt{1+\frac{r_1^2}{d^2}}-1\right)+2\ln\left[\frac{r_1(\sqrt{R^2+d^2}-d)}{R(\sqrt{r_1^2+d^2}-d)}\right]\right] \tag{27}$$

where $d=(z_2=z)$ is the distance from the point with potential, U to the target. The potential as represented by equation (27) is illustrated schematically in FIG. 3.

With ions present, it will be assumed that the potential is of the same form as equations (24), (26) or (27) but reduced by a factor $(1-f)$, where f is the neutralization fraction defined above.

Note that for a 100 kV, 600 mA electron beam, $U_o=32.8$ V whereas the average kinetic energy of an ion ($N_2^+$) is $\overline{T}_I=4.3$ V. Thus, initially most of the ions are trapped in the well. If the beam is scanned transversely at a velocity $v_s$, then this is also a component of the apparent velocity of the ions in the reference frame of the beam. For a typical scan speed of $10^4$ cm/sec., the kinetic energy of an ion due to this motion is only 1.4 mV, which is very much less than $\overline{T}_I$. Thus, from the point of view of ion accumulation and neutralization, the fact that the beam is scanning may be ignored.

3.0 DEPENDENCE OF NEUTRALIZATION ON GAS PRESSURE

3.1 Calculation of Equilibrium Neutralization

Using equation (26) it can be seen that an ion created at a radius r in a partially neutralized electron beam can escape from the beam (i.e., reach $r\geqq r_1$) only if its kinetic energy $T_I$ is such that $$T_I\geqq(1-f)U_o(1-r^2/r_1^2) \tag{28}$$

Hence, assuming a uniform distribution of ions in the beam the fraction of ions which can escape is $$\left(1-\frac{r_{min}^2}{r_1^2}\right)=\frac{\overline{T_I}}{(1-f)U_o} \tag{29}$$

where $r_{min}$ is the minimum radius which satisfies formula (28) for $T_I=\overline{T}_I$.

Hence using formulae (20) and (29), the number of ions $N_I$ in a length l of beam increases at a rate given by $$\frac{dN_I}{dt}=\sigma N_A l\frac{I}{e}-\frac{N_I\overline{T_I}}{(1-f)U_o\bar{t}} \tag{30}$$

where $\bar{t}$ is the average time required for an ion starting at radius $r>r_{min}$ to escape from the beam.

Equilibrium is reached when the R.H.S. of equation (30) is equal to zero, i.e.:

$$N_I=\frac{\sigma N_A lI(1-f_o)U_o\bar{t}}{e\overline{T_I}}$$

Hence the equilibrium value of the neutralization fraction, $f_o$ is given by $$\frac{f_o}{1-f_o}=\frac{\sigma N_A\beta cU_o\bar{t}}{\overline{T_I}} \tag{31}$$

which shows the expected behavior as a function of pressure, p: $f_o\propto p$ at low pressure and $f_o\rightarrow 1$ as $p\rightarrow\infty$ . . . .

The quantity $\bar{t}$ in equation (31) may be written as $w/v_I$ where w is an effective width of the beam. (It is assumed that w depends only on the geometry of the beam and vacuum chamber and that w is constant in a given apparatus. The value of w is not calculated here, but it is found empirically as described later.)

Using equations (22), (23), (25) and (31) we get $$\frac{f_o}{1-f_o}=\frac{\sigma N_A M^2 wS}{4m^2} \tag{32}$$

3.2 Threshold Pressure for Ion Aided Focusing

The threshold for I.A.F. is defined as the number of gas atoms per unit volume $N_{Ath}$ or the pressure, $p_{th}$ at which the self-forces of the beam are zero, i.e.,: $A=0$ in equation (1) or $f=1/\gamma^2$ in equation (2).

Hence, using equation (32):

$$N_{Ath}=\frac{4m^2}{\sigma M^2 wS\gamma^2\beta^2} \tag{33}$$

Therefore the equilibrium value of the neutralization fraction is in general given by:

$$\frac{f_o}{1-f_o}=\frac{N_A}{\gamma^2\beta^2 N_{Ath}}=\frac{p}{\gamma^2\beta^2 p_{th}} \tag{34}$$

where p is the gas pressure.

Thus, $$f_o=\frac{p/p_{th}}{p/p_{th}+\gamma^2\beta^2} \tag{35}$$

and $$A=\frac{\gamma^2\beta^2(p/p_{th}-1)}{p/p_h+\gamma^2\beta^2} \tag{36}$$

It is interesting to note that the threshold pressure is almost independent of the kinetic energy of the electrons in the non-relativistic region since $\beta^2\rho$ in equation (33) is approximately constant (see equation (19)).

3.3 Summary of Theory

In a scanning electron beam computed tomography scanner with ion aided focusing, the radius of the beam spot at the target is given approximately by the solution of equation (18). (Exact solution for a given geometry requires a numerical integration):

$$\frac{d^2r}{dz^2}=\frac{-SA}{2r}+\frac{\epsilon_2^2}{r^3}-\frac{gz_2}{3r_o} \tag{15}$$

where $$A=\frac{\gamma^2\beta^2(p/p_{th}-1)}{p/p_h+\gamma^2\beta^2} \tag{36}$$

and $$\epsilon_2^2=\epsilon_o^2+\frac{gr_o^2(z_1+z_2)}{3} \tag{7}$$

The multiple scattering parameter g is given by equation (3) and is proportional to gas pressure. All symbols have been defined previously.

As an example, the attraction factor A and neutralization fraction f (equation (35)) are plotted against $p/p_{th}$ for T=100 kV in FIG. 5. At the same electron energy and a gas (nitrogen) pressure of $2.5\times10^{-6}$ Torr, $g=2.04\times10^{-10}$ cm$^{-1}$. Hence with initial emittance, $\epsilon_o=11.1\pi$ mm mr, $r_o=5$ cm and $(z_1+z_2)=380$ cm, as in the present apparatus, $\epsilon_2=13.7\pi$ mm mr.

4.0 DEMONSTRATION OF VARIATION OF BEAM SPOT SIZE WITH PRESSURE

Experiments have been performed with the prototype scanner described in Section 5 below, to measure the minimum attainable beam spot radius at the target as a function of ambient gas (nitrogen) pressure and beam current with 100 kV electrons. For each measurement the beam was scanned along a tungsten target at a rate of 66.0 m/sec. Tungsten wire beam monitors were mounted just in front of the target. The electron current collected by these monitors was passed through a resistor to ground and the voltage across this resistor observed on an oscilloscope. The resulting oscilloscope traces were representations of the beam profile from which the full width at half maximum could be obtained. The radius, $r_t$ of the beam spot was defined as half this width. For each data point the solenoid and quadrupole coil currents and the ion collector voltage were adjusted for the best circular beam spot. Measurements were also made at very low currents (~10 mA)

in order to measure the beam emittance and the emittance-limited beam spot radius $r_{to}$. Data in the form of the ratio ($r_t/r_{to}$), at beam currents of 300 mA and 600 mA ($S_{FWHM}=3.75\times10^{-4}$) are plotted in FIG. 6.

The theoretical expression (18) was fitted to this data as shown by solid lines, using the effective beam width w, in expression (33), as a free parameter. The result established that for nitrogen the threshold pressures for ion aided focusing are $2.5\times10^{-6}$ Torr ($N_A=1.83\times10^{11}$ $cm^{-3}$) and $5.0\times10^{-6}$ Torr at beam currents of 600 mA and 300 mA respectively. The corresponding value of the effective width, w is 19.5 cm a result compatible with the dimensions of the beam and vacuum chamber.

FIG. 6 illustrates graphically the dependence of beam spot radius on gas pressure. At low pressures there is a plateau where stable space charge limited focusing occurs. The typical beam spot radius in this region for 600 mA of 100 kV electrons is 7.6 mm. As the pressure increases the beam becomes neutralized, its self repulsion decreases and the beam spot radius shrinks. The radius reaches a minimum close to the threshold pressure for ion aided focusing where the self forces of the beam are exactly balanced. Beyond this pressure the radius increases again because of multiple scattering in the gas. As the beam current decreases, so do the self forces of the beam and the threshold pressure increases. Also plotted in FIG. 6 is the beam spot radius for zero current which depends only on the initial beam emittance and multiple scattering. As can be seen the theory presented here is compatible with the experimental data although there is only limited information on the magnitude of the multiple scattering term.

Still referring to FIG. 6, it should be noted that the higher gas pressure necessary for I.A.F. overcomes the problem of target degassing which seems to be inherent in a scanner with high vacuum (and spacecharge limited focusing) as stated previously. Whenever the beam is scanned along the target, the latter is instantaneously heated and emits (unknown) gases—enough to raise the residual or ambient gas pressure by a few times $10^{-7}$ Torr. In a high vacuum scanner, the effect can raise the pressure to as much as $5\times10^{-7}$ Torr during the scan, which, as can be seen from FIG. 6, lies in a range in which the beam spot size and focusing forces vary rapidly with pressure. This effect also prevents an immediate re-scan and the use of the cine mode. With a base pressure of about $3\times10^{-6}$ Torr, as in I.A.F., the absolute increase in pressure due to degassing is the same but the relative increase is less (for example, only $3.0\times10^{-6}$ to $3.5\times10^{-6}$ Torr) and as can be seen from FIG. 6, the beam spot size hardly changes at all over this range.

5.0 PRACTICAL DETAILS OF ION AIDED FOCUSING SCANNER

5.1 Apparatus

The basic shell of the prototype scanner is shown in FIG. 1. The essential features and devices which are required to operate it in the ion aided focusing mode are shown schematically in FIG. 7. These essential features are listed below.

(a) The high vacuum impedance anode of the electron gun permits differential pumping whereby the residual gas pressure in the gun ($\sim5\times10^{-8}$ Torr) is maintained at a much lower value than the gas pressure in the main chamber ($\sim3\times10^{-6}$ Torr). The low pressure in the gun is necessary for proper operation of the cathode. The only vacuum connection between the gun and main chamber is through the 1 cm diameter × 10 cm long beam aperture in the anode.

(b) Separate vacuum pumps for the gun and main chamber are necessary for differential pumping. The speeds of these pumps in the present apparatus are 30 liter/sec and 1000 liter/sec respectively. The main chamber pump is situated near the gun end of the chamber so that the pressure in the cone is slightly higher than that in the first section of the chamber.

(c) Ion collecting electrodes are provided at steps in the first section of the main chamber in order to remove ions from the electron beam in this region as described in the co-pending Rand application.

(d) A solenoidal focus coil provides control of the focusing, but the dipole deflecting coils, quadrupole coils and the beam itself also provide focusing forces. The solenoid and dipole coils form part of the scanner disclosed in the Boyd patent.

(e) Quadrupole focusing coils have been installed inside the deflecting coils. These quadrupoles correct the differential focal length of the deflecting coils, which is a function of azimuthal deflection angle. The quadrupoles must be driven dynamically. It is necessary to equalize the focal lengths in order to produce a cylindrical beam and maximize the self-focusing forces.

(f) In the cone, a means is provided of maintaining the gas pressure at a preset level. This is achieved by means of a commercial variable leak valve, controlled by a constant pressure controller, which is supplied with a pressure signal from a vacuum gauge and gauge controller. A constant pressure gas supply is also required. A suitable gas is pure dry nitrogen at approximately atmospheric pressure.

(g) The high power density in the beam spot ($\sim$20 $kW/mm^2$) requires that the beam be scanned at a rate sufficient to prevent melting of the tungsten target. The rate used, $\sim$66 m/sec, is adequate and safe in the present apparatus.

5.2 Operation

When minimizing the beam spot radius for a given beam current and gas pressure, it is necessary to adjust both the solenoidal focus coil current and the ion collecting electrode voltage. When properly adjusted, the latter provides a fine control of the focusing, by adjusting the divergence of the incident beam at the solenoid (see FIG. 2). Ranges of acceptable values for the two variables are shown as a function of pressure in FIGS. 8 and 9. The straight lines drawn through the data points show that for a given setting of both variables, the pressure may be allowed to vary by approximately $\pm0.2\times10^{-6}$ Torr. This is a range which adequately covers pressure variations due to target out-gassing during a scan. The settings are relatively insensitive to pressure and it is a simple matter to select acceptable operating conditions with chamber gas pressures ranging from 2.0 to $3.5\times10^{-6}$ Torr at 600 mA. The preferred pressure at this current is $2.7\times10^{-6}$ Torr. At 300 mA, even though the threshold pressure is higher, a slightly lower operating pressure is preferred.

In the present apparatus, the acceptable pressure range is ultimately limited at its lower extreme to about $1\times10^{-6}$ Torr, where fluctuations due to target outgassing become significant, and at the upper extreme to about $4\times10^{-6}$ Torr, above which vacuum pressure in the gun becomes intolerably high. Both these limits could be extended by using higher speed vacuum pumps.

For optimum control of the beam, it is absolutely necessary that the ion collecting electrode voltage be adjusted as well as the solenoidal coil current. The electrode voltage adjusts the beam size and divergence at the solenoid, which must be correct for optimum focusing. Using the theory of operation of the ion collecting electrodes developed in the Rand co-pending patent application, it is found from the values of necessary applied voltage that the neutralization fraction of the diverging beam is about 2%. To maintain this approximate value, the electrode voltage must be increased with gas pressure.

6.0 SELECTION OF GAS

Dry high purity nitrogen and argon have been used as the ambient gas in the prototype I.A.F. scanner. There are probably other gases present in the chamber such as water vapor, hydrocarbons, and metal vapors. Nitrogen is cheap and entirely suited to the present purpose. The threshold pressures for ion aided focusing at typical scanner beam currents fall within the practical range and at these pressures multiple scattering is a small effect. The threshold pressure in a lighter gas such as helium ($\sim 10^{-3}$ Torr) would be much too high for practical purposes in the present design, unless beam currents were much higher. Then helium might become advantageous since multiple scattering would be less at a given pressure. A practical problem unique to helium is that it is difficult to pump at low pressures. A heavier gas which is an alternative to nitrogen is argon. Under the same beam conditions this has a threshold pressure lower than nitrogen and produces about the same multiple scattering at threshold. Gases heavier than argon would produce too much multiple scattering at the necessary operating pressure.

7.0 SUMMARY

A scanning electron beam computed tomography scanner with ion aided focusing of the electron beam has been described. The essential features of the scanner are (a) differential vacuum pumping at the gun anode, (b) separate vacuum pumps on the gun and main chamber, (c) ion collecting electrodes in the first section of the chamber, (d) a solenoidal focusing coil, (e) quadrupole focusing coils, (f) pressure control in the main chamber and (g) means of scanning the electron beam at a rate sufficient to prevent melting of the tungsten target but slow enough to retain ions in the potential well of the beam. With a 600 mA beam of 100 kV electrons, and a gas (nitrogen) pressure of $2.7\times10^{-6}$ Torr, the radius of the beam spot achieved is about 0.5 mm, more than one order of magnitude smaller than that obtained by any other known method.

What is claimed is:

1. An electron beam production and control assembly especially suitable for use in producing X-rays in a computed tomography X-ray scanning system, said assembly comprising:

(a) a housing defining an elongated vacuum-sealed chamber having opposite rearward and forward ends;

(b) a target located at the forward end of said chamber, said target being the type which produces X-rays when impinged by an electron beam;

(c) means for producing an electron beam within said chamber at its rearward end and for directing the beam along a path towards the forward end of the chamber in a continuously expanding manner;

(d) focusing means located within said chamber at a location intermediate its rearward and forward ends and in the path of said beam for directing said beam towards said target in a continuously converging manner whereby to impinge on said target for producing X-rays; and (e) means for neutralizing the converging segment of said beam in a controlled manner sufficient to cause it to converge to a greater extent at the time it impinges said X-ray target than it otherwise would have in the absence of said controlled neutralization, whereby to decrease the area of said target impinged by said converging beam segment, said neutralizing means including means for maintaining the gas pressure at a preset level within the section of said chamber containing the converging beam segment, said gas pressure maintaining means including means for leaking a specific gas into said chamber section containing said converging beam segment in a controllable manner, means for pumping gas out of said chamber section, means for sensing the pressure within said chamber section, and means responsive to said sensing means for controlling said gas leaking means for maintaining the gas pressure within said chamber at said preset level.

2. An assembly according to claim 1 wherein said preset pressure level is between about $1\times10^{-6}$ and $4\times10^{-6}$ Torr.

3. An assembly according to claim 1 wherein said beam producing and directing means includes ion collecting electrode means located within the section of said chamber containing the expanding segment of said beam for collecting ions within this chamber section so as to prevent said expanding beam segment from being significantly neutralized.

4. An assembly according to claim 1 wherein said focusing means includes a solenoidal focus coil, said assembly also including dipole deflecting coils at said intermediate location for bending said converging beam segment towards said target at an angle to the initial path of said beam.

5. An assembly according to claim 4 including magnetic quadrupole focusing coils cooperating with said dipole deflecting coils for equalizing the focal lengths of the combination in the bend plane of said beam and in the transverse plane therethrough, regardless of the azimuthal angle of the bend, whereby to be able to produce a circular beam spot at said target, and hence to maximize the self-focusing forces of the beam.

6. An assembly according to claim 1 wherein said beam producing and directing means includes an electron gun at the back end of said chamber, said gun having a high vacuum impedance anode or aperture which permits differential pumping and which ensures proper cathode operation, whereby the residual gas pressure in the gun is maintained at a much lower value than the pressure in said chamber.

7. An assembly according to claim 6 including a first vacuum pump forming part of said electron gun and a second vacuum pump for pumping gas out of said chamber.

8. An electron beam production and control assembly especially suitable for use in producing X-rays in a computed tomography X-ray scanning system, said assembly comprising:

(a) a housing defining an elongated vacuum-sealed chamber having opposite rearward and forward ends, said chamber including a rearward chamber section extending in one direction and a forward chamber section extending in the opposite direction and a transverse direction;

(b) a target located at the forward end of said chamber, said target being the type which produces X-rays when impinged by an electron beam;

(c) means for producing an electron beam within said chamber at its rearward end and for directing the beam along said rearward chamber section towards said forward chamber section in a continuously expanding manner, said beam producing and directing means including an electron gun adjacent to the back end of said chamber, said gun having a high vacuum impedance anode or aperture and its own vacuum pump in order to permit differential pumping and to ensure proper cathode operation, whereby the residual gas pressure in said gun can be maintained at a much lower value than the pressure in said chamber, said beam producing and directing means also including ion collecting electrode means located in said rearward chamber for collecting ions therein in order to prevent said expanding beam from being neutralized;

(d) means located near the back end of said chamber for maintaining a low gas pressure in the latter;

(e) means located within said chamber between said rearward and forward chamber sections for bending the beam and redirecting it in a continuously converging manner through the forward section of said chamber towards said target, whereby to impinge on the target for producing X-rays, and for scanning the beam along the target, said last-mentioned means including a solenoidal focus coil, dipole deflecting coils and magnetic quadrupole focusing coils cooperating with one another to bend said beam and cause it to continuously converge, said magnetic quadrupole focusing coils cooperating with said dipole deflecting coils for equalizing the focal lengths of the combination in the bend plane of said beam and in the transverse plane therethrough, regardless of the azimuthal angle of the bend, whereby to be able to produce a circular beam spot at said target and hence to maximize the self-focusing forces of the beam; and (f) means for neutralizing the converging beam in a controlled manner sufficient to cause it to converge to a greater extent at the point it impinges said X-ray target than it otherwise would have in the absence of said controlled neutralization, whereby to decrease the beam spot size on the target, said neutralizing means including means for maintaining the gas pressure at a preset level within the forward section of said chamber, said gas pressure maintaining means including means for leaking a specific gas into said chamber section containing said converging beam segment in a controlled manner, means for pumping gas out of said chamber section in a controlled manner, means for sensing the pressure within said chamber section, and means responsive to said sensing means for controlling said gas leaking means for maintaining the gas pressure within said forward chamber section at said preset level.

9. An electron beam production and control assembly especially suitable for use in producing X-rays in a computed tomography X-ray scanning system, said assembly comprising:

(a) a housing defining an elongated vacuum-sealed chamber having opposite forward and rearward ends;

(b) means for producing an electron beam within said chamber and for directing said beam along a path therethrough from its rearward end to its forward end, whereby to impinge on a suitable target located at said forward end for producing X-rays; and (c) means for neutralizing said beam in a controlled manner within a forward end section of said chamber as it approaches said target and in a manner which causes it to have a smaller cross-sectional configuration in the plane of said target than it would otherwise have in the absence of controlled neutralization, whereby to decrease the area of said target impinged by said beam, said neutralizing means including means for maintaining the gas pressure at a preset level within the said forward end section of said chamber, said gas pressure maintainring means including means for leaking a specific gas into said chamber section in a controllable manner, means for pumping gas out of said chamber section, means for sensing the pressure within said chamber section, and means responsive to said sensing means for controlling said gas leaking means for maintaining the gas pressure within said chamber at said preset level.

10. An assembly according to claim 9 wherein said neutralizing means includes means for providing said chamber with positive ions in a way which allows the latter to interact with electrons forming said beam sufficient to cause said beam to become neutralized in said controlled manner, said positive ion providing means including said specific gas which interacts with said electron beam causing the gas to ionize and thereby produce said ions.

11. An assembly according to claim 9 wherein the negative charge on the electrons forming said beam results in electrostatic repulsive forces between the electrons and wherein said beam produces its own magnetic field resulting in opposing attractive forces which are normally lesser in magnitude than the repulsive forces whereby the beam has a natural tendency to expand, said neutralizing means neutralizing said beam in a manner which reduces said repulsive forces to a magnitude approximately equal to the magnitude of said attractive forces whereby the area of said target impinged by said beam is limited in size mostly by the emittance of said beam.

12. An assembly according to claim 9 wherein the negative charge on the electrons forming said beam results in electrostatic respulsive forces between the electrons and wherein said beam produces its own magnetic field resulting in opposing attractive forces which are normally lesser in magnitude than the repulsive forces whereby the beam has a natural tendency to expand, said neutralizing means neutrallizing said beam in a manner which reduces said repulsive forces to a magnitude below the magnitude of the attractive forces whereby said beam becomes self-focusing.

13. In an apparatus including electromagnetic means for directing an electron beam onto a target in a continuously converting manner within a vacuum-sealed chamber, an arrangement for aiding said electromagnetic means, said arrangement comprising means for neutralizing the converging beam in a controlled manner sufficient to cause it to converge to a greater extent at the time it impinges said target than it would otherwise have in the absence of said controlled neutralization, whereby to decrease the area of said target impinged by said converging beam, said neutralizing means including means for maintaining the gas pressure within said chamber at a preset value, said gas pressure maintaining means including means for leaking a specific gas into said chamber in a controlled manner, means for pumping gas out of said chamber, means for sensing the pressure within said chamber, and means responsive to said sensing means for controlling said gas leaking means for maintaining the gas pressure within said chamber at said preset level.

14. An electron beam production and control assembly especially suitable for use in producing X-rays in a computed tomography X-ray scanning system, said assembly comprising:

(a) a housing definring an elongated vacuum-sealed chamber having opposite rearward and forward ends;

(b) a target located at the forward end of said chamber, said target being the type which produces X-rays when impinged by an electron beam;

(c) means for producing an electron beam within said chamber at its rearward end and for directing the beam along a path towards the forward end of the chamber in a continuously expanding manner;

(d) focusing means located within said chamber at a location intermediate its rearward and forward ends and in the path of said beam for directing said beam towards said target in a continuously converting manner whereby to impinge on said target for producing X-rays; and (e) means for neutralizing the converging segment of said beam in a controlled manner sufficient to cause it to converge to a greater extent at the time it impinges said X-ray target than it otherwise would have in the absence of said controlled neutralization, whereby to decrease the area of said target impinged by said converging beam segment, said neutralizing means includes means for maintaining the gas pressure at a preset level within a range of about $10^{-6}$ torr to about $10^{-5}$ torr within the section of said chamber containing the converging beam segment.

15. An assembly according to claim 14 wherein said preset pressure level is between about $1\times10^{-6}$ and $4\times10^{-6}$ torr.

16. An electrion beam production and control assembly especially suitable for use in producing X-rays in a computed tomography X-ray scanning system, said assembly comprising:

(a) a housing defining an elongated vacuum-sealed chamber having opposite rearward and forward ends;

(b) a target located at the forward end of said chamber, said target being the type which produces X-rays when impinged by an electron beam;

(c) means for producing an electron beam within said chamber at its rearward end and for directing the beam along a path towards the forward end of the chamber in a continuously expanding manner;

(d) focusing means including a solenoidal focus coil located within said chamber at a location intermediate its rearward and forward ends and in the path of said beam for directing said beam towards said target in a continuously converging manner whereby to impinge on said target for producing X-rays;

(e) dipole deflecting coils at said intermediate location for bending said converging beam segment towards said target at an angle to the initial path of said beam; and (f) means for neutralizing the converging segment of said beam in a controlled manner sufficient to cause it to converge to a greater extent at the time it impinges said X-ray target than it otherwise would have in the absence of said controlled neutralization, whereby to decrease the area of said target impinged by said converging beam segment.

17. An assembly according to claim 16 including magnetic qudrupole focusing coils cooperating with said dipole deflecting coils for equalizing the focal lengths of the combination in the bend plane of said beam and in the transverse plane therethrough, regardless of the azimuthal angle of the bend, whereby to be able to produce a circular beam spot at said target, and hence to maximize the self-focusing forces of the beam.

18. An electron beam production and control assembly especially suitable for use in producing X-rays in a computed tomography X-ray scanning system, said assembly comprising:

(a) a housing defining an elongated vacuum-sealed chamber having opposite rearward and forward ends;

(b) a target located at the forward end of said chamber, said target being the type which produces X-rays when impinged by an electron beam;

(c) means for producing an electron beam within said chamber at its rearward end and for directing the beam along a path towards the forward end of the chamber in a continuously expanding manner;

(d) focusing means located within said chamber at a location intermediate its rearward and forward ends and in the path of said beam for directing said beam towards said target in a continuously converging manner whereby to impinge on said target for producing X-rays;

(e) means for neutralizing the converging segment of said beam in a controlled manner sufficient to cause it to converge to a greater extent at the time it impinges said X-ray target than it otherwise would have in the absence of said controlled neutralization, whereby to decrease the area of said target impinged by said converging beam segment; and (f) said beam producing said directing means including ion collecting electrode means located within the section of said chamber containing the expanding segment of said beam for collecting ions within this chamber section so as to prevent said expanding beam segment from being significantly neutralized.

19. An electron beam production and control assembly especially suitable for use in producing X-rays in a computed tomography X-ray scanning system, said assembly comprising:

(a) a housing defining an elongated vacuum-sealed chamber having opposite rearward and forward ends;

(b) a target located at the forward end of said chamber, said target being the type which produces X-rays when impinged by an electron beam;

(c) means for producing an electron beam within said chamber at its rearward end and for directing the beam along a path towards the forward end of the chamber in a continuously expanding manner, said beam producing and directing means including an electron gun at the back end of said chamber said gun having a high vacuum impedance anode or aperture which permits differential pumping and which ensures proper cathode operation, whereby the residual gas pressure in the gun is maintained at a much lower value than the pressure in said chamber.

(d) focusing means located within said chamber at a location intermediate its rearward and forward ends and in the path of said beam for directing said beam towards said target in a continuously converging manner whereby to impinge on said target for producing X-rays; and (e) means for neutralizing the converging segment of said beam in a controlled manner sufficient to cause it to converge to a greater extent at the time it impinges said X-ray target than it otherwise would have in the absence of said controlled neutralization, whereby to decrease the area of said target impinged by said converging beam segment.

20. An assembly according to claim 19 including a first vacuum pump forming part of said electron gun and a second vacuum pump for pumping gas out of said chamber.

21. An electron beam production and control assembly especially suitable for use in producing X-rays in a computed tomography X-ray scanning system, said assembly comprising:

(a) a housing defining an elongated vacuum-sealed chamber having opposite rearward and forward ends;

(b) an elongated target having opposite ends located at the forward end of said chamber, said target being the type which produces X-rays when impinged by an electron beam;

(c) means for producing an electron beam within said chamber at its rearward end and for directing the beam along a path towards the forward end of the chamber in a continuously expanding manner;

(d) means located within said chamber at a location intermediate its rearward and forward ends and in the path of said beam for directing said beam towards said target in a continuously converging manner whereby to impinge on said target for producing X-rays and for causing said beam to scan across said target from one end to an opposite end thereof; and (e) means for neutralizing the converging segment of said beam in a controlled manner sufficient to cause it to converge to a greater extent at the time it impinges said X-ray target than it otherwise would have in the absence of said controlled neutralization, whereby to decrease the area of said target impinged by said converging beam segment.

22. An assembly according to claim 21 wherein said beam directing and scanning means includes means for scanning said beam at a rate of about 6 cm/msec.

* * * * *

UNITED STATES PATENT AND TRADEMARK OFFICE

CERTIFICATE OF CORRECTION

PATENT NO. : 4,521,901

DATED : June 4, 1985

INVENTOR(S) : Roy E. Rand

It is certified that error appears in the above—identified patent and that said Letters Patent is hereby corrected as shown below:

Column 6, line 15: The Equation should read:

$$\frac{d^2r}{dz^2} = -\frac{SA}{2r} + \frac{\varepsilon_o^2}{r^3} + \frac{1}{r^3}\int_{z_o}^{z} r^2 g\, d\xi \qquad \ldots\ldots(1)$$

Column 6, line 30: The Equation should read:

$$S = \sqrt{2m}\,\eta_o KI/I_{SAT}$$

Column 8, line 10: The Equation should read:

$$\int_{o}^{z} r^2 g\, d\xi \simeq \frac{gr_o^2}{z_1^2}\int_{o}^{z} \xi^2 d\xi = \frac{gr_o^2}{3z_1^2} z^3 = \frac{gz_1 r^3}{3r_o} \qquad \ldots\ldots(4)$$

Column 8, line 22: The Equation should read:

$$\int_{z_1}^{z} r^2 g\, d\xi \simeq \frac{gr_o^2}{z_2^2}\int_{z_1}^{z} [(z_1 + z_2) - \xi]^2 d\xi \qquad \ldots\ldots(6)$$

UNITED STATES PATENT AND TRADEMARK OFFICE

CERTIFICATE OF CORRECTION

PATENT NO. : 4,521,901

DATED : June 4, 1985

INVENTOR(S) : Roy E. Rand

It is certified that error appears in the above—identified patent and that said Letters Patent is hereby corrected as shown below:

Column 8, line 63: The Equation should read:

$$z = \int \frac{dr}{(dr/dz)} \qquad \text{.....(10)}$$

Column 9, line 53: The Equation should read:

$$z = \frac{r_g}{\sqrt{SN}} \int_1^{\Delta} \frac{da}{\sqrt{\ln a}} \qquad \text{.....(14)}$$

$$= \frac{2r_g}{\sqrt{SN}} \int_0^{\sqrt{\ln \Delta}} \exp(t^2)\,dt$$

where $\Delta = r/r_g$

UNITED STATES PATENT AND TRADEMARK OFFICE

CERTIFICATE OF CORRECTION

PATENT NO. : 4,521,901

DATED : June 4, 1985

INVENTOR(S) : Roy E. Rand

It is certified that error appears in the above—identified patent and that said Letters Patent is hereby corrected as shown below:

Column 11, line 58: The Equation should read:

$$\overline{T_I} = (\gamma\beta m)^2/M \qquad \text{.....(22)}$$

Column 12, line 36: The Equation should read:

$$d = (z_2 - z)$$

Column 14, line 9: The Equation should read:

$$A = \frac{\gamma^2\beta^2(p/p_{th} - 1)}{p/p_{th} + \gamma^2\beta^2} \qquad \text{.....(36)}$$

Column 14, line 13: Delete "$\beta^2\rho$" and insert --$\beta^2\sigma$--.

Column 10, line 25: The Equation should read:

$$SA\ln\frac{r_o}{r_t} - \frac{\varepsilon_2^2}{r_t^2} + \frac{\varepsilon_0^2}{r_{to}^2} = 0 \qquad \text{.....(18)}$$

UNITED STATES PATENT AND TRADEMARK OFFICE

CERTIFICATE OF CORRECTION

PATENT NO. : 4,521,901

DATED : June 4, 1985

INVENTOR(S) : Roy E. Rand

It is certified that error appears in the above—identified patent and that said Letters Patent is hereby corrected as shown below:

Column 20, line 23: delete "maintainring" and insert --maintaining--.

Column 20, line 66: delete "converting" and insert --converging--.

Column 21, line 20: delete "definring" and insert --defining--.

Column 21, line 34: delete "converting" and insert --converging--.

Signed and Sealed this

*Fourteenth* Day of *January 1986*

[SEAL]

*Attest:*

DONALD J. QUIGG

*Attesting Officer*

*Commissioner of Patents and Trademarks*